US005257667A

United States Patent [19]

Sano et al.

[11] Patent Number: 5,257,667

[45] Date of Patent: Nov. 2, 1993

[54] VIBRATING PILE DRIVER

[75] Inventors: Yuji Sano, Nara; Fubito Shimada, Kawasaki, both of Japan

[73] Assignee: Kencho Kobe Co., Ltd., Osaka, Japan

[21] Appl. No.: 790,617

[22] Filed: Nov. 8, 1991

[30] Foreign Application Priority Data

Jan. 24, 1991 [JP] Japan ..... 3-007283

[51] Int. Cl.[5] ..... E02D 7/18

[52] U.S. Cl. ..... 173/49; 173/128; 405/232

[58] Field of Search ..... 173/128, 125, 130, 132, 173/49, 31, 104, 205; 175/56, 185; 405/232

[56] References Cited

U.S. PATENT DOCUMENTS 3,033,394 5/1962 Kashergen ..... 214/138
3,909,149 9/1975 Century ..... 173/49

FOREIGN PATENT DOCUMENTS 1634275 3/1970 Fed. Rep. of Germany .
0012429 2/1981 Japan ..... 405/232
0089022 6/1982 Japan ..... 173/49
0184128 11/1982 Japan ..... 173/49
0184129 11/1982 Japan ..... 405/232
0051521 3/1988 Japan ..... 173/49

OTHER PUBLICATIONS

Patent Abstract of Japan, vol. 6, No. 181 (M-156) (1059) 17 Sep. 1982 and JP-A-57 089 023 (Kensetsu Kikai Chiyousa) 3 Jun. 1982.

*Primary Examiner*—Frank T. Yost
*Assistant Examiner*—Allan M. Schrock
*Attorney, Agent, or Firm*—Pennie & Edmonds

[57] ABSTRACT

A first rotation driving mechanism including a hydraulic motor (26), a driving gear (27), and a driven gear (29) is provided between a coupling arm unit (12) attachable to the operational arm of a construction machine such as a hydraulic shovel, etc., and a hanger unit (14) to relatively rotate them in the horizontal plane, and at the same time, a second rotation driving mechanism including a hydraulic cylinder (32) and a rocking arm (34) is provided between the hanger unit (14) and a main body (20) to rotate them in the vertical plane. The positional changes of the hanger unit (14) and the main body (20) are automatically performed by a remote control rapidly and easily, and further, with safety to improve the mobility and operativity of the piling, and the pile installation and removal.

6 Claims, 5 Drawing Sheets

VIBRATING PILE DRIVER

FIELD OF THE INVENTION

The present invention relates to a vibrating pile driver of a construction machine comprising a coupling arm unit attached to the operational arm of the construction machine (e.g., hydraulic shovel, etc), a rotary hanger unit attached to the coupling arm, and a vibration generating apparatus consisting of a main body and a chunk which is attached to the rotary hanger unit.

BACKGROUND OF THE INVENTION

Generally, a vibrating pile driver actuates its vibrator to vibrate a chuck in the direction (usually, vertical direction) of piling while the pile is being held by the chuck to perform its operation in such a manner that the pile is sunken (driven) into the ground with the weights of the pile driver and the pile itself while frictional resistance between the pile and the ground is kept small. Also, as it is possible to keep the frictional resistance between the pile and the ground small by vibration, such operation is utilized for drawing from the ground the pile which has been driven thereinto.

The type of a vibrating pile driver of the kind is generally such that the driver is suspended from a crane or the like. However, in order to improve the mobility and the handling operativity, the applicant hereof has developed a vibrating pile driver 50, as shown in FIG. 4 and FIG. 5, which comprises a coupling arm unit 12 attachable to the operational arm 5 of a construction machine such as a hydraulic shovel, etc., which is structured to allow its position shifted; a hanger unit 14 connected to this coupling arm unit 12, which is relatively rotated in the vertical plane and the horizontal plane; a main body 20 having a vibrator 15 for generating the exciting power and a chuck 16 holding a pile while being vibrated by the vibrator 15, which is connected to the hanger unit 14 and is relatively rotated in the vertical plane.

In a vibrating pile driver such as referenced by a numeral 50, the coupling arm unit 12, hanger unit 14, and main body 20 can interrelatedly change the positions thereof to adjust arbitrarily the direction of a pile or the direction of the piling operation, and at the same time, to perform the piling operation rapidly without a problem in a narrow place such as a farm road or an alleyway or in a place where buildings are in the immediate vicinity. Moreover, at the time of installing, removing, or replacing the pile, it is possible to install the pile sideways (in the horizontal direction) or to remove the pile from the chuck 16 after having rotated the main body 20 in the vertical plane to position the main body 20 horizontally against the hanger unit 14. Hence, these operations can be performed with ease and safety.

However, in the above-mentioned vibrating pile driver 50, the rotation of the hanger unit 14 against the coupling arm unit 12 in the horizontal plane and the vertical plane are respectively performed by an operator manually. Therefore, there are still problems encountered that these operations are not only troublesome and complicated, but present some aspects which requires a further consideration in respect of the safety.

With a view to solving these problems, the present invention has been designed, and an object thereof is to provide a vibrating pile driver which automatically performs the positional changes of the hanger unit and the main body without any manual operations by an operator.

In order to achieve the above-mentioned object, a vibrating pile driver according to the present invention comprises fundamentally a coupling arm unit attachable to the operation arm, etc. of a construction machine such as a hydraulic shovel, etc.; a hanger unit connected to this coupling arm unit, which is relatively rotated in the vertical plan and the horizontal plane; and a main body having a vibrator for generating the exciting power and a chuck to be vibrated by the above-mentioned vibrator while holding the pile, which is connected to the above-mentioned hanger unit and is relatively rotated in the vertical plane.

Then, in addition to the above structure, a first rotation driving mechanism is provided between the coupling arm unit and the hanger unit to relatively rotate them in the horizontal plane and/or a second rotation driving mechanism is provided between the hanger unit and the main body to relatively rotate them in the vertical plane.

SUMMARY OF THE INVENTION

In the vibrating pile driver of the present invention having the structure set forth above, the hanger unit is relatively rotated against the coupling unit automatically by the first rotation driving mechanism. Also, the main body is relatively rotated against the hanger unit automatically by the second rotation driving mechanism. Hence, the positional changes of the hanger unit and main body can be performed automatically by the remote control rapidly and easily, and further, with safety, so that the mobility and operativity of the pile driving, the pile installation and removal, etc. can be improved.

BRIEF DESCRIPTION OF THE DRAWINGS

The present invention will subsequently be described according to an embodiment shown in the drawings.

DETAILED DESCRIPTION OF THE PREFERRED EMBODIMENTS

Hereinafter, in reference to the accompanying drawings, an embodiment according to the present invention will be described.

Figure 1:
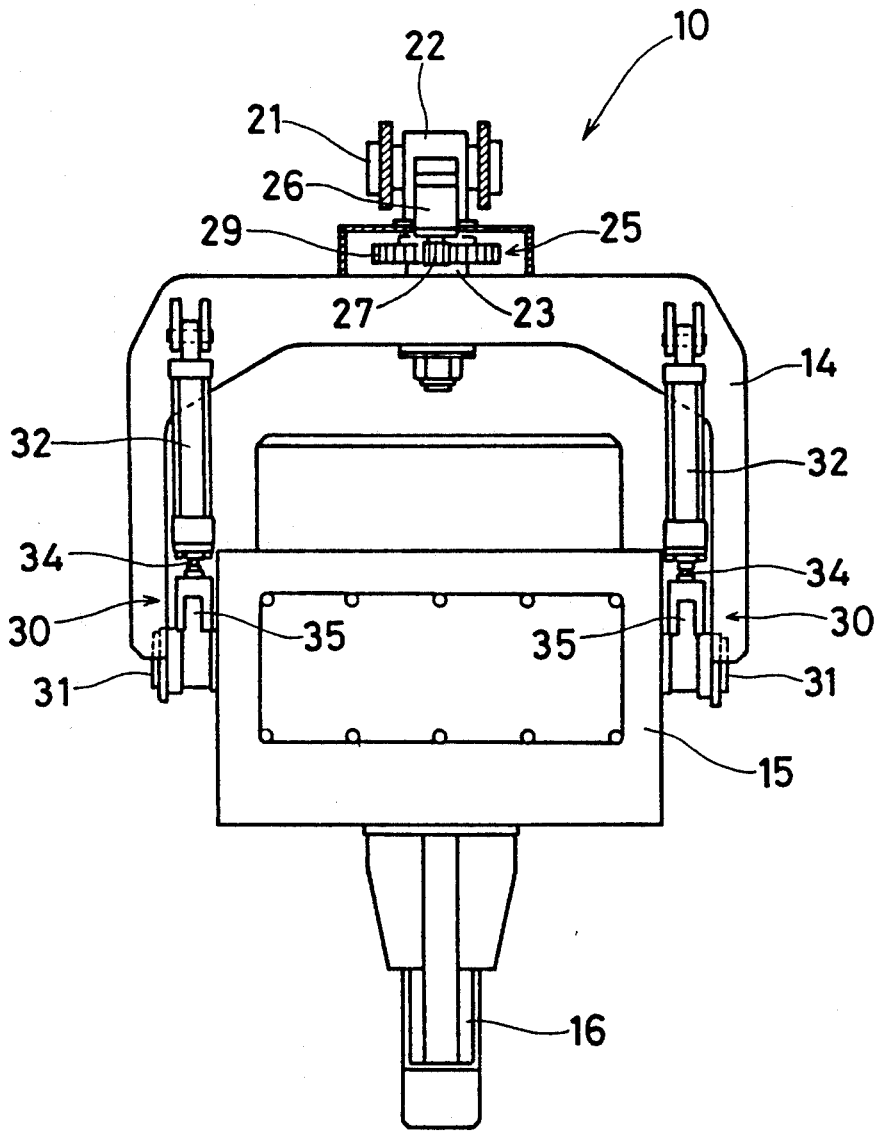
FIG. 1 is a front view showing an embodiment of a vibration generating apparatus according to the present invention.
Figure 2:
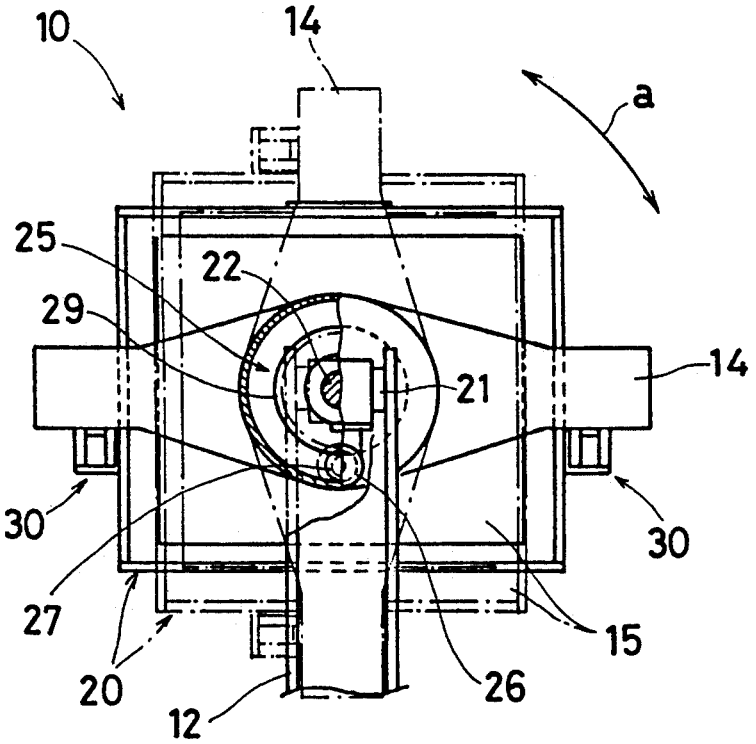
FIG. 2 is a plan view showing the embodiment shown in FIG. 1.
Figure 3:
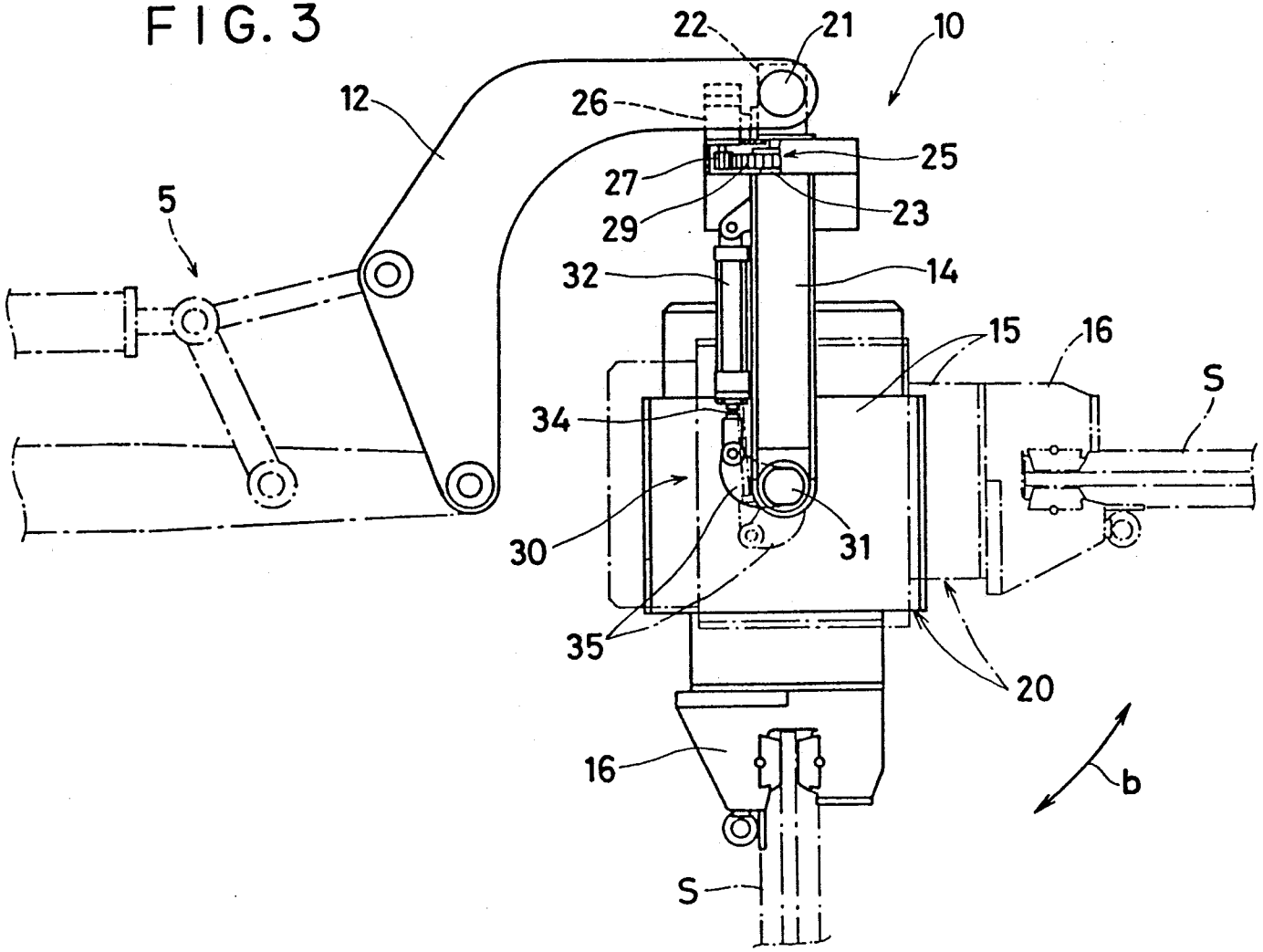
FIG. 3 is a side view showing the embodiment shown in FIG. 1.
Figure 4:
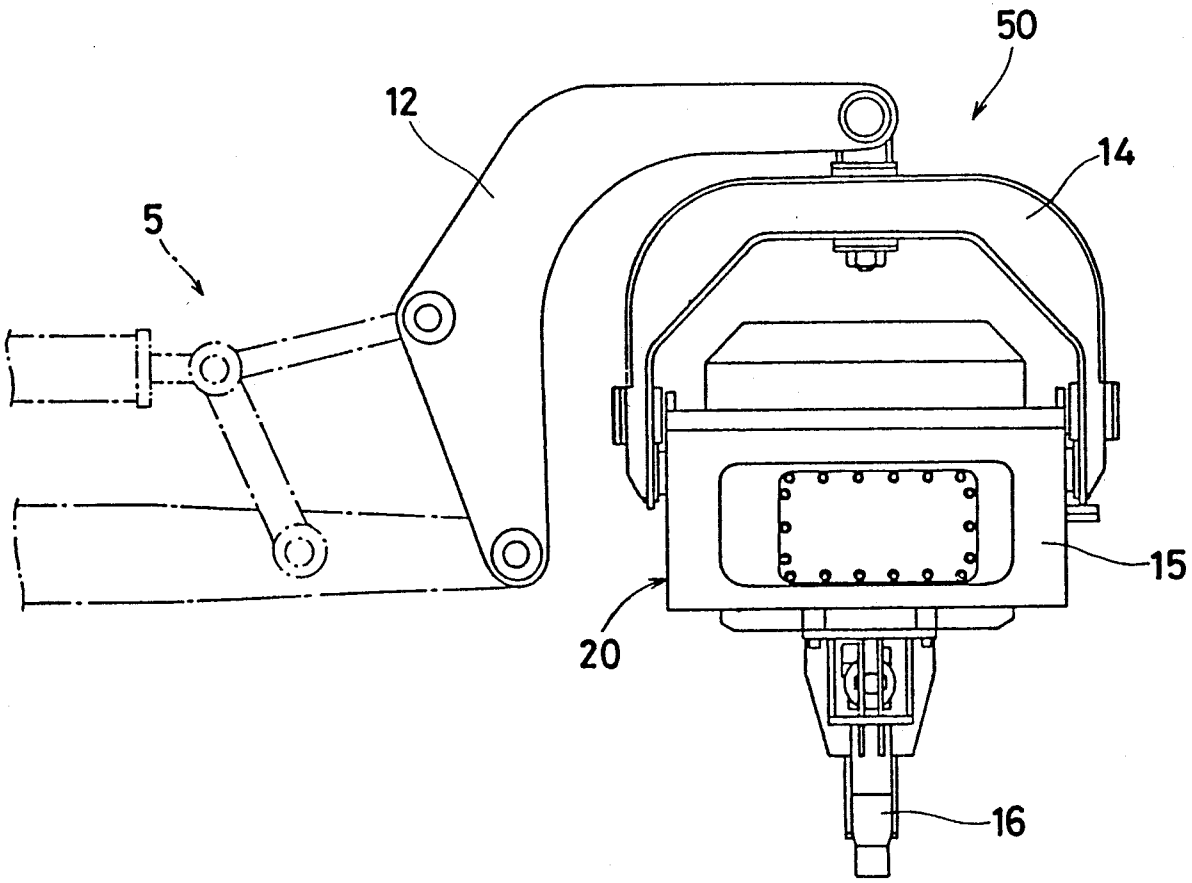
FIG. 4 PRIOR ART
FIG. 4 is a view showing a conventional vibrating pile driver.
Figure 5:
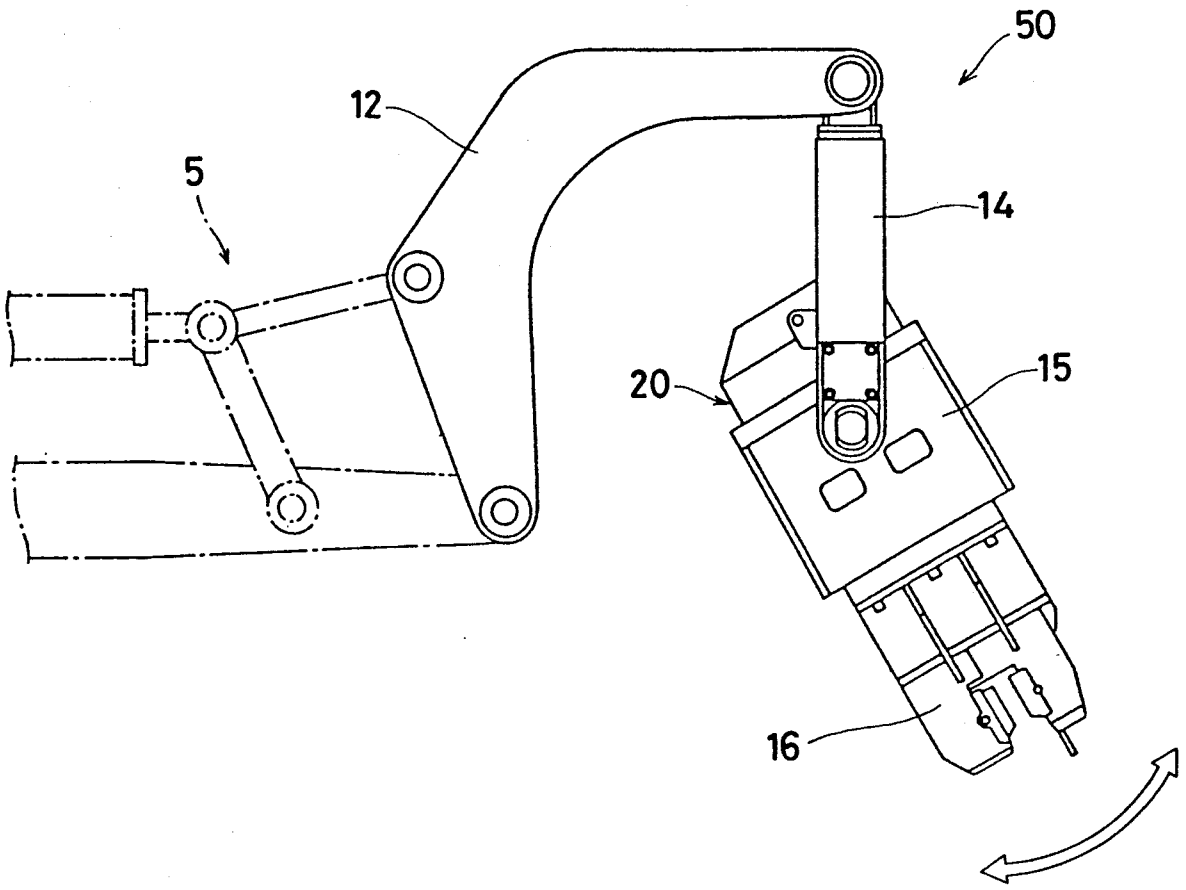
FIG. 5 PRIOR ART
FIG. 5 is a view illustrating the operation of the positional changes of the conventional example shown in FIG. 4.

FIG. 1 is a front view showing an embodiment of a vibration generating apparatus according to the present invention. FIG. 2 and FIG. 3 are a plan view and a side view showing the apparatus respectively. In these figures, the units corresponding to those of the conventional vibrating pile driver 50 shown in the aforesaid FIG. 4 and FIG. 5 are referenced by the same marks, and any duplicating descriptions thereof are omitted.

A vibrating pile driver 10 of the present embodiment is provided with a coupling arm unit 12 attachable to the operational arm 5 of a construction machine such as hydraulic shovel, etc., which is structured to allow its position to be shifted as in the conventional driver described earlier, and one end of a suspension shaft 22 is fitted in a supporting shaft 21 mounted at the leading end of this coupling arm 12 so that the suspension shaft can be rotated in the horizontal plane. To the other end of the suspension shaft unit 22, a hanger unit 14 is supported through a bearing unit 23 so that the hanger unit can be rotated in the horizontal plane.

Then, a first rotation driving mechanism 25 is inclusively mounted between the suspension shaft unit 22 and the hanger unit 14 to couple them. The first rotation driving mechanism 25 includes a hydraulic motor 26 fixed to the suspension shaft unit 22, a driving gear 27 fixed to the rotational shaft thereof, a driven gear 29, which is fixed to the bearing unit 23 integrated with the hanger unit 14, to engage with the driving gear 27.

Also, in the hanger unit 14, a main body 20 is supported through a pair of rotational shafts 31 so as to be relatively rotated in the vertical plane. The main body 20 comprises a vibrator 15 which generates the exciting power by the supply and exhaust of the activated hydraulic pressure from the hydraulic pressuring unit externally arranged (not shown), and a chuck 16 installed at the lower end of this vibrator 15, which causes a pile S to be vibrated vertically in a state where the pile is being held by the chuck. The main body 20 as a whole is structured to rotate integrally with the rotational shaft 31.

Subsequently, a pair of second rotation driving mechanism 30 are inclusively arranged between the hanger unit 14 and the main body 20 to couple them. Each of the second rotation driving mechanisms 30 is structured to include a hydraulic cylinder 32, the trailing end of which is rotatably fixed to the hanger unit 14, and a rocking arm 35, the one end of which is rotatably connected to the leading end of the piston rod 34 of the hydraulic cylinder 32 while the other end thereof is fittedly fixed to the rotational shaft 31 connecting the hanger unit 14 and the main body 20.

The hydraulic motor 26 of the above-mentioned first rotation driving mechanism 25 and the hydraulic cylinder 32 of the second rotation driving mechanism 30 are respectively operated, for example, by the activated hydraulic pressure from the hydraulic pressuring unit common to the vibrator 15, for example. The operational control is therefore performed, for example, by a remote control through an operation board provided in the driver's seat, etc., of the hydraulic shovel. With the hydraulic motor 26 being in motion, the hanger unit 14 is rotated in the horizontal plane integrally with the driven gear 29 as indicated by arrow a in FIG. 2. Then, the positions of the hanger unit 14 and the main body 20 are shifted against the coupling arm unit 12. On the other hand, when the hydraulic cylinder 32 is actuated, the rocking arm 35 is rotated integrally with the rotational shaft 31 as indicated by arrow b in FIG. 3. Thus, the position of the main body 20 is shifted in the vertical plane.

In this way, the positional changes of the hanger unit 14 and the main body 20 are automatically performed by the remote control rapidly and easily, and further, with safety, thus making it possible to improve the mobility and operativity of the piling, and the pile installation and removal, etc.

In this respect, the structures, etc. of the first rotation driving mechanism 25 and the second rotation driving mechanism 30 are not limited to those set forth above, and as a matter of course, the hydraulic motor 26 can be replaced by an electric motor while a pneumatic cylinder can be employed in place of the hydraulic cylinder 32.

We claim:

1. A vibrating pile driver comprising:

a coupling arm unit attachable to an operational arm of a construction machine such as a hydraulic shovel;

a hanger unit rotatably coupled to said coupling arm unit to permit rotation of said hanger unit about a first axis relative to said coupling arm unit;

a main body having a vibrator for generating an exciting power and a chuck for holding a pile to be vibrated by said vibrator, said main body being rotatably coupled to said hanger unit to permit rotation of said main body about a second axis relative to said hanger unit, said second axis being substantially perpendicular to said first axis;

a first rotation driving mechanism provided between said coupling arm unit and said hanger unit for rotating and positioning said hanger unit about said first axis a second rotation driving mechanism provided between said hanger unit and said main body for rotating and positioning said main body about said second axis.

2. A vibrating pile driver according to claim 1, wherein at least one of the first rotation driving mechanism and the second rotation driving mechanism is controlled by a remote control.

3. A vibrating pile driver, comprising:

a main body including means for generating vibration and chuck means for holding a pile;

hanger means for rotatably supporting said main body to permit rotation of said main body about a first axis relative to said hanger means;

coupling means for rotatably securing said hanger means to an operational arm of a machine to permit rotation of said hanger means about a second axis relative to the operational arm, said second axis being substantially perpendicular to said first axis; and first rotational driving means mounted between said hanger means and coupling means for rotating and positioning said hanger means relative to said coupling means about said second axis; and a second rotational driving means mounted between said hanger means and said main body for rotating and positioning said main body relative to said hinge means about said first axis.

4. The pile driver according to claim 3, further comprising:

supporting shaft carried by said coupling means;

suspension shaft carried by said supporting shaft substantially transverse to said supporting shaft; and bearing means mounted with said hanger means for rotationally securing said hanger means to said suspension shaft;

wherein said first rotational means comprises motor means mounted on said suspension shaft and cooperating with said bearing means for rotating said hanger means in the second plane.

5. The pile driver according to claim 3, wherein said second rotational means comprises cylinder means operationally connected to said hanger means and said main body for extending rod means cooperating with said main body in said first axis.

6. The pile driver according to claim 3, wherein said vibrating means, said first rotational means and said second rotational means are actuable by a common source.

* * * * *